United States Patent [19]

Roccaforte

[11] 4,266,671

[45] May 12, 1981

[54] CARTON HANGER-OPENER

[75] Inventor: Harry I. Roccaforte, Western Springs, Ill.

[73] Assignee: Champion International Corporation, Stamford, Conn.

[21] Appl. No.: 64,881

[22] Filed: Aug. 8, 1979

[51] Int. Cl.[3] ..... B65D 5/54

[52] U.S. Cl. ..... 206/626; 206/806; 229/DIG. 11

[58] Field of Search ..... 206/806, 626, 625, 622, 206/621; 229/DIG. 11, 52 B

[56] References Cited

U.S. PATENT DOCUMENTS

| | | | |
|---|---|---|---|
| 1,992,195 | 2/1935 | Daller | 206/625 |
| 2,002,364 | 5/1935 | Daller | 206/622 |
| 2,293,342 | 8/1942 | Inman | 229/52 B |
| 2,659,524 | 11/1953 | McElwee | 229/52 B |
| 2,848,154 | 8/1958 | Hanson | 229/52 B |
| 3,033,362 | 5/1962 | Marcalus | 206/806 |
| 3,625,411 | 12/1971 | Cote | 206/806 |
| 3,946,936 | 3/1976 | Brown | 206/806 |
| 4,201,292 | 5/1980 | Davidson et al. | 206/621 |

FOREIGN PATENT DOCUMENTS

| | | | |
|---|---|---|---|
| 601064 | 6/1978 | Switzerland | 229/52 B |

*Primary Examiner*—Stephen P. Garbe
*Attorney, Agent, or Firm*—Evelyn M. Sommer

[57] ABSTRACT

In a carton of rectangular cross-section having first and second side wall panels, first and second end wall panels and top and bottom closure panels, an improved top closure panel comprising a hang tab extending upwardly from the top of one of said side wall panels, said tab being integrally formed with and pivotally attached to the top edge of said one of said side wall panels, a top cover panel integrally formed with and hingedly attached to the top edge of the other one of said side walls and extending across the top of said carton, said top cover panel including an extension thereon, means attaching said extension to said tab, and a tear strip integrally formed in, removably attached along all its sides but one to, and hingedly attached along said one side thereof to said top edge of said one of said side wall panels for opening the top of said carton to remove the contents thereof, said tear strip, when detached from said carton along said removably attached sides, being folded under said tab about said hinge whereby said tab may be folded downwardly and tucked in said open carton top to close said carton.

2 Claims, 7 Drawing Figures

CARTON HANGER-OPENER

BACKGROUND OF THE INVENTION

The present invention relates to a carton of substantially rectangular cross-section and in particular to such a carton which can be hung on a protrusion such as a hook of a peg board display and yet which can be shipped in substantially rectangular form with product therein and which can be stacked and shipped in their fully loaded condition without interference from the hang tab. Further, the novel carton is of one piece contruction and is so formed that a generally V-shaped tear strip is contructed in one of the sides thereof such that once the carton is opened and some of the contents are removed, the tear strip is folded under the hang tab and the hang tab becomes the reclosable top flap.

It is desirable to construct paperboard packages of the rectangular box form from one piece blanks which are appropriately scored, folded and glued into the shape of the desired box. It is also desirable to provide such one piece blanks with hang tabs or elements by which the box may be hung from a protrusion such as a peg extending from a pegboard rack. Finally, it is desirable to construct a one piece paperboard blank from which may be formed a desired carton and which has a convenient means for opening the carton when it is folded and glued to its proper shape and filled with the desired contents.

The prior art cartons constructed of one piece paperboard with hang tabs integrally formed as a part thereof do not make provisions for placing the hang tab out of the way during storage and shipping thereby creating storage and stacking problems. Further, those prior art cartons formed from a single blank and having a hang tab as an integral part thereof make no provisions for reclosing the carton once it has been opened.

SUMMARY OF THE INVENTION

The present invention overcomes the disadvantages of the prior art by constructing a carton of paperboard from a one piece blank which can be appropriately scored, folded and glued into the shape of a desired box and which has a hang tab as an integral part thereof which may be folded down over the side of the carton and detachably attached to the carton side for shipping and storage purposes and which may be detached from the carton side and pivoted upwardly to a vertical position for hanging the carton on a peg or other protrusion for display purposes. The carton also has formed therein an opening means which is so integrally formed with the hang tab and a side wall of said carton that once the carton has been opened, the hang tab may be folded and tucked inside the carton to reclose it if desired.

Thus, the invention relates to a carton of rectangular cross-section comprising a hang tab extending upwardly from one edge of the top of said carton and having an orifice therein for supporting said carton on a projection extending through said orifice, a fold line attaching said hang tab to said one edge of said top of said carton, and means for removably attaching said hang tab to the side of said carton when said tab is folded downwardly about said fold line whereby a carton of substantially rectangular cross-section is maintained for shipping and storage purposes.

The invention also relates to a carton of rectangular cross-section having first and second side wall panels, first and second end wall panels and top and bottom closure panels, a hang tab extending upwardly from the top of one of said side wall panels, said tab being integrally formed with and pivotally attached to the top edge of said one of said side wall panels and a tear strip integrally formed in, removably attached along all its sides but one to, and hingedly attached along said one side thereof to said top edge of said one of said side wall panels for opening the top of said carton to remove the contents thereof, said tear strip, when detached from said carton along said removably attached sides, being folded under said tab about said hinge whereby said tab may be folded downwardly and tucked in said open carton top to reclose said carton.

The invention also relates to a one piece paperboard blank for forming a carton having an improved top closure for hanging, opening and reclosing said carton comprising first and second side wall panels hingedly connected along one side by a first end wall panel, and a second end wall panel hingedly connected to the remaining side of said first side wall panel for forming a carton of substantially rectangular cross-section when erected, bottom closure panels hingedly attached to the bottom edges of said first and second side wall panels and said first and second end wall panels for closing the bottom of said carton, a first flap integrally formed with and pivotally attached to the top of said first side wall panel and having a detachable tab for forming an orifice therein for use in hanging said carton on a protrusion, and extended panel integrally formed with and pivotally attached to the top of said second side wall panel, said extended panel comprising a second flap having dimensions substantially equal to the cross-section of said rectangular carton for closing the top thereof, and a third flap pivotally attached to said second flap by a score line and having a detachable tab corresponding to said detachable tab in first flap, said third flap being congruent with and fastened to said first flap in an overlapping relationship to form a unitary hang tab pivotally attached to said carton at the junction of said first flap and said first side wall panel whereby said detachable tab may be removed and said carton hung on a protrusion extending through the orifice formed by said removed tab, and a generally V-shaped tear strip integrally formed in said first side wall panel and being pivotally attached along the upper portion of said V to said carton at the junction of said first flap and said first side wall panel and removably attached to said first side wall panel along the remaining edges thereof whereby when said tear strip is torn from said first side wall panel along said remaining edges and pivoted about said upper edge it not only opens the top of said carton and allows access to said carton interior but also is smaller than and fits under said second flap thereby allowing said hang tab to be inserted into said open carton top thereby reclosing said carton.

BRIEF DESCRIPTION OF THE DRAWINGS

These and other objects and advantages of the present invention will be disclosed in the course of the following specification, reference being had to the accompanying drawings in which.

DETAILED DESCRIPTION OF THE PREFERRED EMBODIMENT

Figure 1:
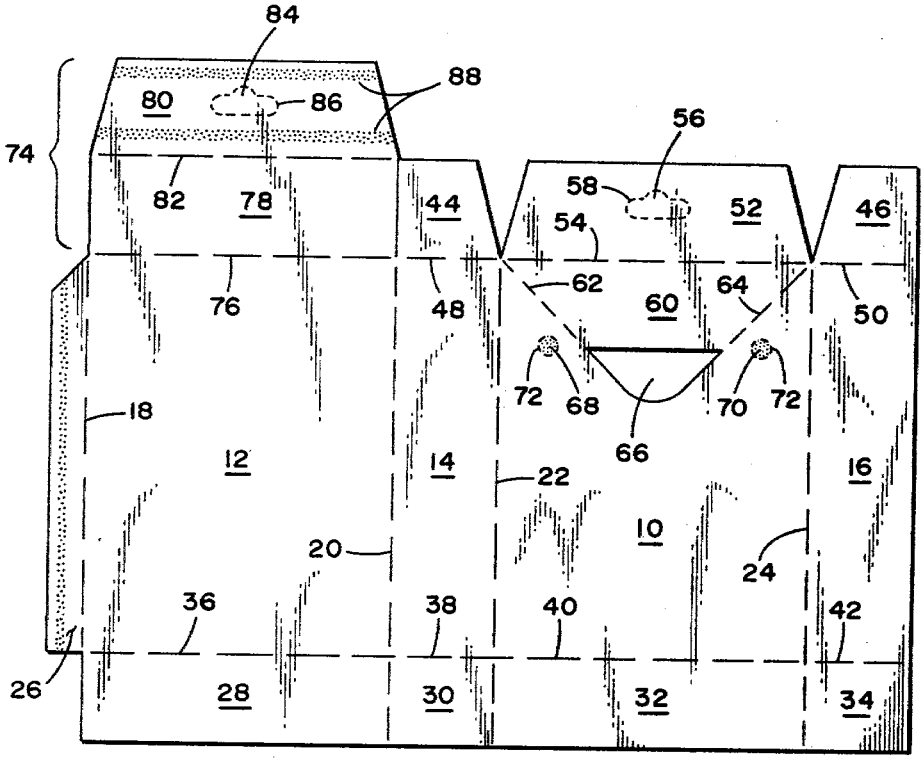
FIG. 1 is a plan view of a blank representing the preferred embodiment of the present invention from which the desired carton may be formed by appropriately folding and gluing the blank into the preferred pattern.

FIG. 1 is a plan view of the unitary blank which is properly cut and scored so that it can be folded and glued into the shape of the desired carton. The unitary blank comprises first side wall panel 10 and second side wall panel 12 integrally formed with and hingedly connected to each other by end wall panel 14. A second end wall panel 16 is hingedly connected to the remaining edge of first side wall panel 10. When the carton is folded about score lines 18, 20, 22, and 24, glue flap 26 lies under and is attached to end wall panel 16 thereby forming a carton of generally rectangular cross-section. Bottom closure flaps 28, 30, 32 and 34 are folded about their respective score lines 36, 38, 40 and 42 and properly glued to form the bottom of the carton. Top closure flaps 44 and 46 are hingedly attached along hinge lines 48 and 50 to the top edges of the respective end wall panels 14 and 16.

A first flap 52 is hingedly attached to the top of first side wall panel 10 along score line 54. A detachable tab 56 is formed in said first flap 52 and is held in place by perforations 58 which may be easily dislodged or torn loose to remove tab 56. Also formed in the top of said first side wall panel 10 is a generally V-shaped tear strip 60 which is held in place by perforated tear lines 62 and 64. The lower part of V-shaped tear strip 60 is truncated to form an opening 66 so that a pointed object such as the thumb may be inserted therein to removed tear strip 60 when desired. Detachable glue panels 68 and 70 are held in place by perforations 72 which are torn and the panels removed if pressure is applied thereto.

An extended panel 74 is integrally formed with and attached along score line 76 to the top of second side wall panel 12 and includes a second flap 78 and a third flap 80 which is attached to second flap 78 by means of score line 82. A second detachable tab 84 is formed in third flap 80 and held in place by perforations 86. Detachable tab 84 is of identical shape and congruent with detachable tab 56 in first flap 52. Glue strips 88 are formed across third flap 80 in order to attach third flap 80 in an overlapping and congruent relationship with first flap 52 as will be disclosed hereafter.

Figure 2:
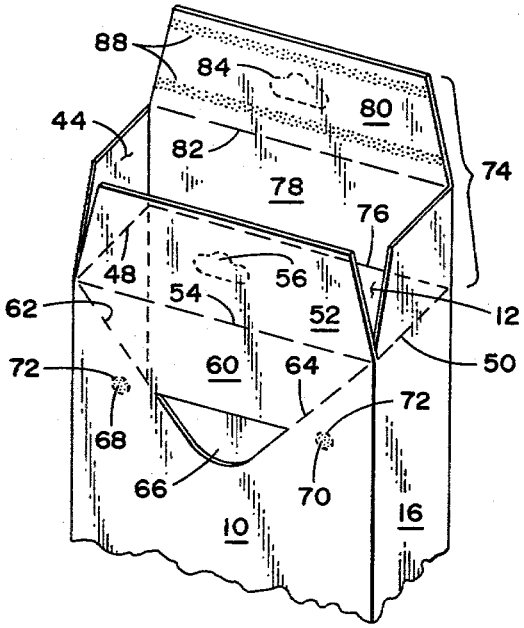
FIG. 2 is a partial isometric view of the improved top closure of the carton of the present invention illustrating the various flaps and fold lines which enable the desired carton to be formed.

FIG. 2 is a partial isometric view of the erected carton with the various panels of the top of said carton illustrated in their relationship to each other. Thus, attached to the top of front or first side panel 10 along score line 54 is first flap 52 having therein detachable tab 56. Also formed in the top of front or first side wall panel 10 is V-shaped tear strip 60 detachably held in place by perforations 62 and 64. Inasmuch as the lower edge of V-shaped tear strip 60 is in the form of a truncated cone, an orifice 66 is formed for the purpose of inserting a pointed object such as the finger to be able to remove tear strip 60 from the front or first side wall panel 10. Obviously, the size of orifice 66 can be adjusted so that the desired result can be achieved without losing the carton contents. Also formed in the front or first side wall panel 10 of the carton are glue panels 68 and 70 detachably held in place by perforations 72. Extended panel 74 is hingedly attached along score line 76 to the back or second side wall panel 12 of the carton and comprises a second flap 78 attached to a third flap 80 by means of score line 82. Third flap 80 has a detachable tab 84 formed therein and has glue strips 88 thereon for the purpose of attaching third flap 80 to first flap 52 in overlapping and congruent relationship as shown in FIG. 3.

Figure 3:
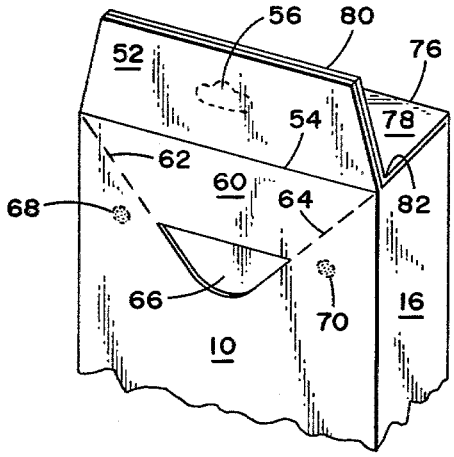
FIG. 3 is a partial isometric view of the carton of the present invention in its erected state with the hang tab in a position to mount or hang the carton on a projection such as a peg.

FIG. 3 is partial isometric view of the folded carton with panels 80 and 52 glued together to form the hang tab 90. Thus, as can be seen in FIG. 3, extended panel 74 has been folded about score line 76 such that second flap 78 is lying across the top of and closes the carton. Third flap 80 is folded about score line 82 and is glued to first flap 52 in an overlapping and congruent relationship. In the position shown in FIG. 3, the detachable tabs 56 and 84 which are in an overlapping relationship may be removed and the carton hung on a peg or other projection which extends through the orifice formed by removing detachable tabs 56 and 84. Thus, the carton as shown in FIG. 3 is ready for display purposes when hung from a peg or projection extending from a display unit.

Figure 4:
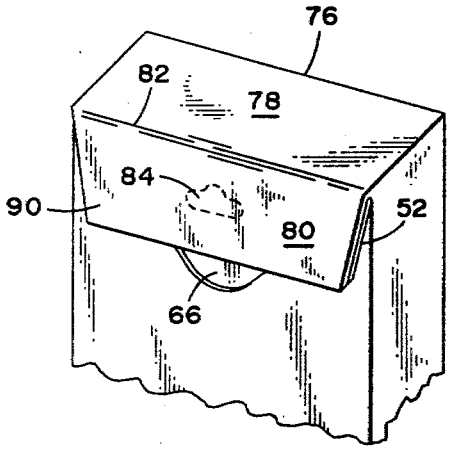
FIG. 4 is a partial isometric view of the carton of the present invention with the hang tab folded down and removably attached to one side of the carton in preparation for the carton being shipped with the product contained therein.

However, the carton as shown in FIG. 3 is not in a practical configuration for shipping whenever the carton has been filled with its desired contents. The hang tab 90 as shown in FIG. 3 poses a problem in stacking and storing the filled cartons inasmuch as there is an overlapping relationship between the hang tab 90 and adjacent cartons. This problem is overcome with the carton of the present invention by utilizing glue panels 68 and 70 shown in FIG. 3 to detachably fasten hang tab 90 out of the way for shipping and storage purposes. Thus, as shown in FIG. 4, hang tab 90 is folded downwardly about score line 82 and attached to glue panels 68 and 70 which have glue applied thereto. As can be seen in FIG. 4, with hang tab 90 in the position shown, the carton forms a generally rectangular shape with the hang tab out of the way so that adjacent cartons can abut each other without overlapping or hindering the movement of each other. As can be seen in FIG. 4, orifice 66 extends partially from under hang tab 90 so that a projection such as the finger or thumb can be placed under hang tab 90 and apply pressure thereto to remove it from the side of the carton where it is detachably fastened. The carton would then appear as it is shown in FIG. 3 except that glue panels 68 and 70 would have been removed with the force applied to hang tab 90 as shown in FIG. 5.

Figure 5:
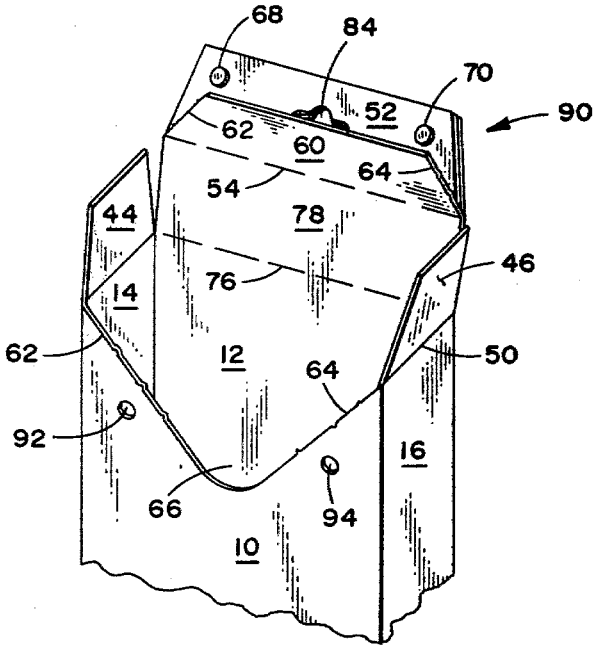
FIG. 5 is a partial isometric view of the carton in its opened state with the tear strip removed from the side panel and illustrating the relationship of the removed tear strip to the hang tab.

FIG. 5 is a partial isometric view of the carton in its opened condition. By placing the thumb or other projection in orifice 66 and lifting up on V-shaped tear strip 60, the tear strip is removed along perforated lines 62 and 64 thus opening the top of the carton. Tear strip 60 is left, however, attached at score line 54 which joins second flap 78 and combined first and third flaps 52 and 80 respectively. Further, the pressure applied to hang tab 90 causes the glue panels 68 and 70 to be removed from front or first side wall panel 10 thus leaving orifices 92 and 94 with the removable tabs 68 and 70 joined to first flap 52. In the state shown in FIG. 5, the contents of the carton may be removed. In this state, the carton could be rehung on a peg or projection by placing orifice 84 over the projection with the carton in its open state as shown.

However, if it is desired to reclose the carton rather than hang the carton on a projection, tear strip 60 and flaps 52 and 78 must be so folded as to enable the carton top to be closed.

Figure 6:
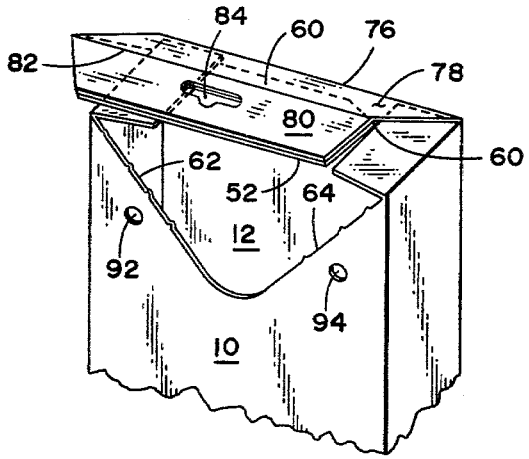
FIG. 6 is a partial isometric view of the carton of the present invention illustrating the relationship of the tear strip and the hang tab as the hang tab is being prepared for use to reclose the opened carton.

FIG. 6 illustrates how the carton can be reclosed. Generally V-shaped tear strip 60 is folded under second flap 78 and combined, glued, first and third flaps 52 and 80 are folded about score line 82. Combined first flap 52 and third flap 80 can then be tucked inside the carton to form a top panel for reclosing the carton.

Figure 7:
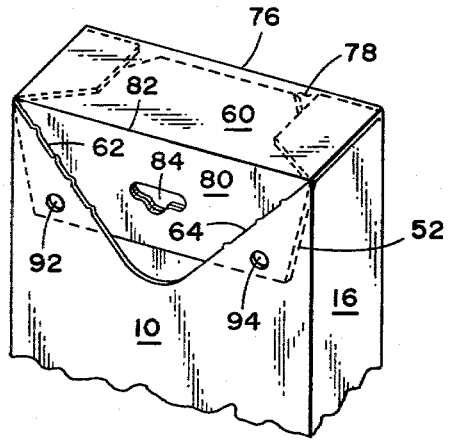
FIG. 7 is a partial isometric view of the carton of the present invention illustrating the manner in which the carton is reclosed by inserting the hang tab within said carton.

FIG. 7 illustrates the carton in its reclosed condition with glued, combined first and third flaps 52 and 80 tucked down inside the carton to completely close the opening left by the removal of tear strip 60 along perforations 62 and 64. In this state of course the carton may be stacked or shipped in the form of a rectangular carton without the interference of any projecting parts thereof.

Thus, there has been disclosed a novel carton and a unitary blank for forming said novel carton in which the carton has a hang tab which can be used by the dealers desiring to display the cartons in a rack by suspending them from a projection or peg or may be displayed or shipped and stored in a rectangular configuration without the hang tab projecting from the carton so as to cause difficulties in stacking or storing. In this condition the hand tab is folded down and removably attached to the side of the carton to keep it out of the way. The novel carton also has an opening device in the front or one of the side panels which is so constructed with the hang tab that when the carton is opened, it can still be displayed by being hung on a projection by the hang tab or the hang tab and the associated tear strip used for opening the carton may be folded in such a way as to be inserted in the carton to close the top thereof.

While the invention has been described in connection with a preferred embodiment, it is not intended to limit the scope of the invention to the particular form setforth, but, on the contrary it is intended to cover such alternatives, modifications, and equivalents as may be included within the spirit and scope of the invention as defined by the appended claims.

What is claimed is:

1. In a carton of rectangular cross-section having first and second side wall panels, first and second end wall panels and top and bottom closure panels, an improved top closure panel comprising:

a. a hang tab extending upwardly from the top of one of said side wall panels, said tab being integrally formed with and hingedly attached to the top edge of said one of said side wall panels, b. a top cover panel integrally formed with and hingedly attached to the top edge of the other one of said side wall panels and extending across the top of said carton, c. a tear strip integrally formed in, removably attached along all its sides but one to, and hingedly attached along said one side thereof to said top edge of said one of said side wall panels for opening the top of said carton to remove the contents thereof, said tear strip, when detached from said carton along said removably attached sides, being folded under said tab about said hinged attachment whereby said tab may be folded downwardly and tucked in said open carton top to reclose said carton, d. said carton further including means for removably attaching said hang tab to said one side wall panel of said carton when said hang tab is folded downwardly about said hinged attachment, e. said means for removably attaching said hang tab to said one side wall panel of said carton including:

i. at least one integrally formed, detachable panel in said one side wall panel of said carton, and ii. glue applied to said detachable panel whereby said hang tab adheres to said detachable panel until such time as force is applied to said hang tab thereby removing said detachable panel from said one carton side wall panel with said hang tab and allowing said hang tab to be moved from a position adjacent said one side wall panel to a vertical position.

2. In a carton of rectangular cross-section having first and second side wall panels, first and second end wall panels and top and bottom closure panels, an improved top closure panel comprising:

a. a hang tab extending upwardly from the top of one of said side wall panels, said tab being integrally formed with and hingedly attached to the top edge of said one of said side wall panels, b. a top cover panel integrally formed with and hingedly attached to the top edge of the other one of said side wall panels and extending across the top of said carton, c. a tear strip integrally formed in, removably attached along all its sides but one to, and hingedly attached along said one side thereof to said top edge of said one of said side wall panels for opening the top of said carton to remove the contents thereof, said tear strip, when detached from said carton along said removably attached sides, being folded under said tab about said hinged attachment whereby said tab may be folded downwardly and tucked in said open carton top to reclose said carton, d. said carton further including means for removably attaching said hang tab to said one side wall panel of said carton when said hang tab is folded downwardly about said hinged attachment, e. said means for removably attaching said hang tab to said one side wall panel of said carton including:

i. a flap integrally formed with and hingedly attached to said top cover panel, said flap being congruent with and attached to said hang tab, ii. an opening formed in said one of said side wall panels adjacent to and abutting said tear strip, and iii. said opening extending from under said downwardly folded hang tab whereby said tab may be grasped and detached from said one side wall panel and said tear strip may be grasped and removed thereby opening said carton.

* * * * *